United States Patent [19]

Kowk

[11] 4,390,006

[45] Jun. 28, 1983

[54] FIREPLACE DOOR ASSEMBLY

[75] Inventor: Ronald Kowk, Weston, Canada

[73] Assignee: Ruth C. Kowk, Weston, Canada

[21] Appl. No.: 227,592

[22] Filed: Jan. 23, 1981

[51] Int. Cl.[3] ..... F24C 15/10

[52] U.S. Cl. ..... 126/140; 126/202; 312/311

[58] Field of Search ..... 126/138, 140, 202, 120, 126/121; 312/214, 242, 311

[56] References Cited

U.S. PATENT DOCUMENTS 1,470,542 10/1923 Poling ..... 126/140

3,192,349 10/1975 Hoetker ..... 312/214

*Primary Examiner*—Ronald C. Capossela

*Attorney, Agent, or Firm*—Fetherstonhaugh & Co.

[57] ABSTRACT

A door frame for a fireplace or the like in which a removable sill member is provided to facilitate the removal of ash from the hearth of an open fireplace.

2 Claims, 6 Drawing Figures

FIG. 3
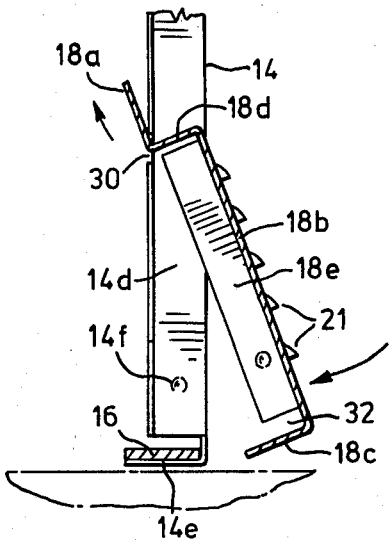
FIG. 4
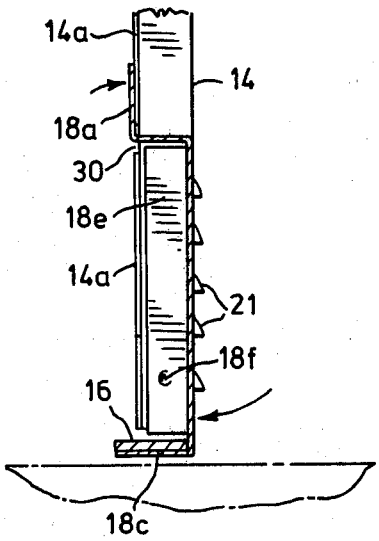
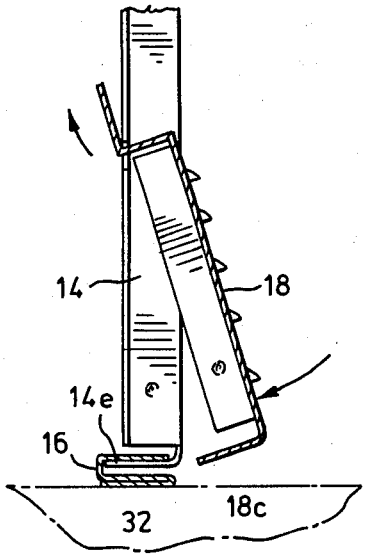
FIG. 5
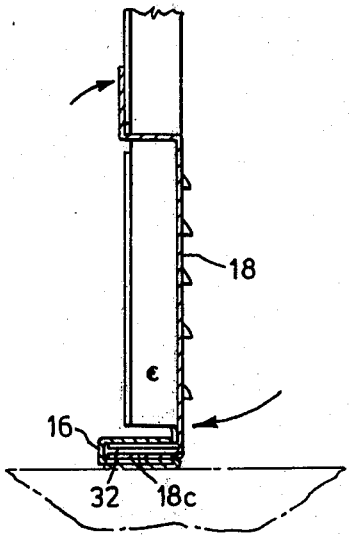
FIG. 6

FIREPLACE DOOR ASSEMBLY

FIELD OF INVENTION

This invention relates to a door frame for a fireplace or the like.

PRIOR ART

Door frames are commonly used for fireplaces or the like to support fireplace doors. The door frame generally consists of a header, a pair of jambs and a sill member. The header and sill member are generally of the same height and the jamb members are generally of a width equal to the height of the sill member. It is important to insure that the header and jamb members in particular are of a substantial height and width respectively to accommodate minor variations in the proportions of fireplace openings. It is also preferred that the sill member be of a substantial height so as to obscure accumulated ash from view. Generally, the jambs and the header and sill have a width and height of the order of about three to four inches. It will be apparent that a sill measuring three to four inches in height will serve to obscure the ash which accumulates in the hearth of an open fireplace. Such a sill does, however, present a substantial obstacle to the direct removal of ash from the hearth of an open fireplace in that it is necessary to raise the ash a substantial height in order to remove it. Thus, while it is desirable to have a sill of a substantial height for aesthetic purposes, such a sill is undesirable from a servicing point of view.

The door frame of the present invention provides a sill of a substantial height for aesthetic purposes which is removable to facilitate the cleaning of the hearth.

SUMMARY OF INVENTION

According to one aspect of the present invention, a door frame for a fireplace or the like comprises a primary frame structure shaped to correspond to the shape of the periphery of a fireplace opening and defines a door opening extending therethrough, said primary frame includes a sill member which is sufficiently short in height that it does not form a significant barrier inhibiting the removal of ash or the like from a hearth when the primary frame is operably positioned with respect to the fireplace opening, a removable sill adapted to be releasably mounted on said primary frame in the position extending upwardly from said fixed sill, said removable sill having a height which is substantially greater than the height of the fixed sill.

PREFERRED EMBODIMENT

The invention will be more clearly understood after reference to the following detailed specification read in conjunction with the drawings, wherein FIG. 1 is a partially sectioned pictorial view of a fireplace door assembly;

FIG. 3 is a sectional side view in the direction of the arrows 3—3 of FIG. 2 showing a first position in the mounting of the removable sill;

FIG. 4 is a sectional view similar to FIG. 3 showing the removable sill mounted in an operable position;

FIG. 5 is a sectional view similar to FIG. 3 showing a different fixed sill construction; and FIG. 6 is a sectional view similar to FIG. 5 showing the manner in which the removable sill is secured with respect to the fixed sill when in an operable position.

Figure 1:
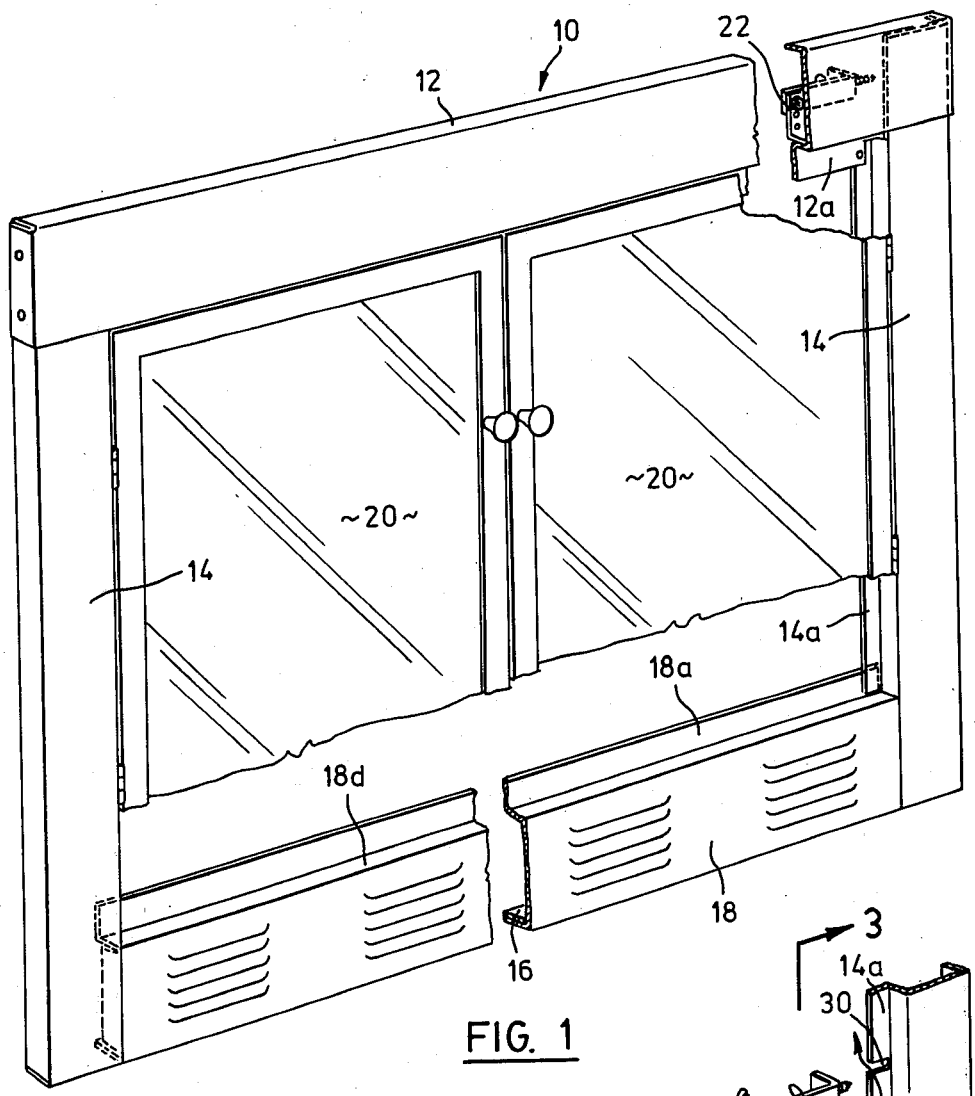

With reference to the drawings, the reference numeral 10 refers generally to a fireplace door assembly of the type commonly used to close the opening of an open fireplace. The frame comprises a header 12, a pair of jambs 14, a fixed sill 16, which together constitute the primary frame structure, and a removable sill 18. A pair of doors 20 are hingedly mounted on the jambs 14. The header 2, jambs 14 and removable sill 18 each have a channel shaped main body portion formed with flanges 12*a*, 14*a* and 18*a* which project inwardly at one edge thereof. The removable sill 18 has a front wall 18*b*, a bottom wall 18*c*, a top wall 18*d* and a pair of end walls 18*e*. A plurality of louver openings 22 are formed in the front wall 18*d* of the removable sill 18. A suitable damper mechanism may be mounted in the channel to permit opening and closing of the louver openings 22 as required in use. Small circular protrusions 18*f* are formed in the end walls 18*e* and shallow dimples 14*f* are formed in the side walls 14*d* of the jambs 14.

In the embodiment illustrated in FIGS. 1 to 4 of the drawings, the fixed sill 16 is in the form of a flat metal strap which extends transversely between the lower ends of the jambs 14 and is secured as by riveting or the like to the end walls 14*e* of the jambs.

Figure 2:
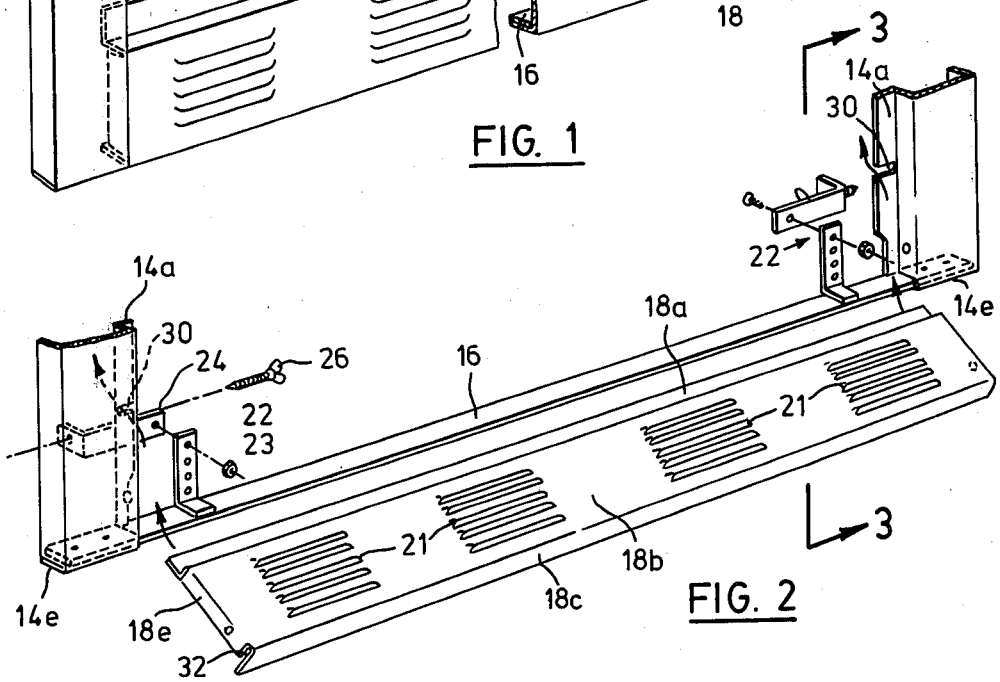
FIG. 2 is an exploded view of the lower portion of the door frame of FIG. 1.

The door frame is secured in the door opening by conventional mounting bracket assemblies 22, one of which is located at each corner of the frame. As shown in FIG. 2, each of the mounting assemblies 22 consists of a first bracket 23, a second bracket 24 and a thumb screw 26. The second bracket 24 is mounted in any one of a number of openings in the first bracket 23 by means of a nut and bolt. The thumb screw 26 projects laterally so as to be engageable with a marginal edge of the fireplace opening to retain the frame in a position extending about the periphery of a fireplace opening.

To permit the mounting and removal of the removable sill 18, notches 30 are formed in the flanges 14*a* and notches 32 are formed between the lower wall 18*c* and the lower edges of the side walls 18*e*. As shown in FIGS. 2, 3 and 4, the removable sill 18 is mounted by inserting the flanges 18*a* through the notches 30 and pivoting the removable sill 18 to move the lower end inwardly to locate the bottom wall 18*c* in a position underlying the fixed sill 16. Engagement of the protrusion 18*f* and the dimple 14*f* serves to retain the removable sill 18 in an upright position with the flange 18*a* disposed inwardly from the flange 14*a* and the end walls 18*e* disposed outwardly from the flange 14*a*.

In FIGS. 5 and 6 the structure of the fixed sill member 16 differs from that illustrated in FIGS. 3 and 4 in that it is in the form of a sheet metal member which is folded upon itself to provide a channel 32 which opens forwardly therefrom. The end wall 14*e* of the jambs 14 is located in the channels 32. The bottom wall 18*c* of the removable sill is proportioned and arranged to fit within the channels 32 when the removable sill 18 is mounted in an operable position with respect to the remainder of the frame. This construction permits the fixed sill 16 to rest on the hearth of a fireplace.

From the foregoing it will be apparent that the header 12, jambs 14 and fixed sill 16 form a primary frame structure on which the removable sill member 18 is removably mounted. When the removable sill member 18 is removed the height of the fixed sill member 16 is so low that it does not represent a substantial barrier to the direct removal of ash from the hearth of the fireplace. When the removable sill member 18 is operably mounted, it has a height sufficient to obscure the ash which normally accumulates on the hearth of a fireplace such as a woodburning fireplace. The doors 20 are hingedly mounted on the jambs 14 and when in a closed position are sealed against the flanges 12*a*, 14*a* and 18*a* in a conventional manner.

In a typical door frame the header, jambs and removable sill have a width measuring about three to four inches and the fixed sill has a thickness of about one-eighth to one-quarter of an inch. Thus with the removable sill in place, it obscures the ash accumulation and with it removed the removal of ash is facilitated.

Various modifications of the present invention will be apparent to those skilled in the art without departing from the scope of the invention.

In one modification the jambs 14 and header 12 may be integrally formed in an arch-shaped configuration so as to have a perimeter corresponding to an arch-shaped fireplace opening.

In a further embodiment, bifold doors may be mounted on jambs.

What I claim as my invention is:

1. A fireplace door assembly comprising, (a) a fabricated frame shaped corresponding to the shape of the periphery of a fireplace door opening and defining a door opening, (b) a door mounted in said frame for opening and closing said door opening, said door having a lower edge, (c) said frame comprising, (i) a pair of jambs, a header and a fixed sill which are secured to one another to form said frame, said fixed sill extending transversely between the lower ends of the jambs so as to extend in close proximity to the hearth of the fireplace in association with which it is to be used, said fixed sill being sufficiently short in height that it does not form a significant barrier inhibiting the removal of ash or the like from the hearth, and (ii) a removable sill adapted to be releasably mounted on said frame in a position extending upwardly from said fixed sill to said lower edge of said door, said removable sill having a substantially greater height than said fixed sill.

2. A door frame as claimed in claim 1 wherein said jambs each have a side flange projecting laterally inwardly of said opening each of side flanges having a front face and a back face and a notch extending therethrough, said removable sill having a lip portion at each end thereof which projects upwardly therefrom and is adapted to extend through said notches whereby the lip portion may be disposed inwardly of the side flanges with the remainder of the sill portion disposed outwardly of the side flanges, said removable sill having a lower flange adapted to releasably engage said fixed sill.

* * * * *